United States Patent [19]

Naito

[11] Patent Number: 4,879,576

[45] Date of Patent: Nov. 7, 1989

[54] EXPOSURE CONTROL DEVICE AND METHOD

[75] Inventor: Yoshikazu Naito, Osaka, Japan

[73] Assignee: Minolta Camera Kabushiki Kaisha, Osaka, Japan

[21] Appl. No.: 166,390

[22] Filed: Mar. 10, 1988

[30] Foreign Application Priority Data

Mar. 13, 1987 [JP] Japan ..... 62-59180
Mar. 13, 1987 [JP] Japan ..... 62-59181
Mar. 13, 1987 [JP] Japan ..... 62-59182

[51] Int. Cl.[4] ..... G03G 15/04; G03G 21/00

[52] U.S. Cl. ..... 355/214; 355/69; 355/77; 355/228

[58] Field of Search ..... 355/14 E, 68, 69, 206, 355/214, 228, 229, 77

[56] References Cited

U.S. PATENT DOCUMENTS 4,215,930 8/1980 Miyakawa et al. ..... 355/14 E X
4,239,374 12/1980 Tatsumi et al. ..... 355/14 E
4,354,758 10/1982 Futaki ..... 355/14 E
4,416,535 11/1983 Tottori ..... 355/14 D
4,508,446 4/1985 Imai ..... 355/14 E X
4,551,005 11/1985 Koichi ..... 355/14 E X
4,657,377 4/1987 Takahashi ..... 355/14 R
4,709,250 11/1987 Takeuchi ..... 355/14 E X
4,711,569 12/1987 Nishimori et al. ..... 355/69
4,725,868 2/1988 Okajo ..... 355/14 E

*Primary Examiner*—Fred L. Braun
*Attorney, Agent, or Firm*—Price, Gess & Ubell

[57] ABSTRACT

An image forming apparatus of a visible image transfer type provided with a standard pattern which is disposed at a position where it can be illuminated by a lamp for illuminating an original, a first sensor for detecting the density of the original and a second sensor for detecting the density of a visible image of a standard pattern. The light amount of the lamp is varied so as to make the density of the visible image detected by the second sensor fit a fixed value or fall within a fixed range, and is designated as a corrective data. The light amount of the lamp, which corresponds with the original density, is corrected in accordance with the corrective data by shifting a characteristic curve which shows the relation between the density of the original and the light amount of the lamp used for the original density measurement.

8 Claims, 5 Drawing Sheets

EXPOSURE CONTROL DEVICE AND METHOD

BACKGROUND OF THE INVENTION

The present invention relates to an exposure control device in an electrostatic image forming apparatus of a visible image transfer type designed to obtain exposure value for appropriate reproducibility when an electrostatic image is formed from an original image by such image forming apparatuses as copiers and laser beam printers.

The electrostatic image forming apparatus of a visible image transfer type forms an electrostatic latent image by projecting an original image on a photosensitive member, and then forms an image on a transfer sheet by transfer of the image after visualizing it through development. In the prior art, in order to obtain an appropriate image, toner supply, development bias, exposure value etc., are controlled singularly or in combination with each other. They are well known by the prior art described in the Japanese Pat. Publn. (KOKAI) No. 58-23043 (Conventional Device 1), the Japanese Pat. Publn. (KOKAI) No. 60-119589 (Conventional Device 2), the Japanese Pat. Publn. (KOKAI) No. 60-133475 (Conventional Device 3), the Japanese Pat. Publn. KOKAI No. 60-146256 (Conventional Device 4) and the Japanese Pat. Publn. (KOKAI) No. 60-260072 (Conventional Device 5). These apparatuses are divided into two types: ones which detect the density of a visible image formed on a photosensitive member and merely control the conditions for development or exposure to make the density of the visible image appropriate, or control such conditions based on the reference level corrected according to temperature, humidity, hysterises time for developing agent, variation in sensitivity of the photosensitive member (Conventional Devices 1, 3, 4 and 5); and, ones which control the exposure so as to reproduce an appropriate contrast in accordance with the contrast obtained from the detected density of an original image (Conventional Device 2). The apparatuses of the former type determine the density of the image to be reproduced irrespective of original density and contrast. Therefore, said method can not deal with certain problems; For example, fine lines which are thinly scattered in a pure white original are very often blurred when reproduced, and images crammed in a pure white original are damaged by fogging through reproduction. On the other hand, the apparatuses of the latter type have better reproducibility of fine lines, which is accomplished at low exposure lamp voltage. However, when dust is stuck to the optical system or the characteristics of the photosensitive member are changed, fogging on the background of the reproduced image for originals with white background, i.e. stains on the background, easily occurs because of the low lamp voltage. It is a significant feature of the system disclosed herein to overcome various of the disadvantages and limitations discussed above.

SUMMARY OF THE INVENTION

The primary object of the present invention is to provide an exposure control device which complies with the requirements aforementioned.

Such an electrostatic image forming apparatus of a visible image transfer type, which forms an electrostatic latent image on a photosensitive member by projecting an original image, and then transfers the image on a transfer material after visualizing it by development, comprises: means for detecting the original density; means for detecting the visible image density on the photosensitive member; controlling means for changing a value lamp voltage for an original to be reproduced based on the visible image density and on the exposure lamp voltage when the visible image density is measured. Two kinds of data are given to the controlling means, i.e. on the original density which is obtained by the original density detecting means, and on the visible image density to represent conditional changes which cause variation in the lamp voltage, through the known original image density at the time when the visible image is formed. The controlling means corrects the lamp voltage corresponding to the detected original density to a proper voltage based on the visible image density and on the lamp voltage when the visible image density was measured. Accordingly, the exposure value to reproduce the original can be correctly determined in accordance with the conditional change, and thus, appropriate image reproduction is assured irrespective of any change either in the original or in the image forming device.

Another object of the present invention is to provide an exposure control device, wherein the correction of the set point for proper lamp voltage based on the visible image density can be made simply and precisely just by shifting the original density proper lamp voltage curve. The feature of the present invention is to provide controlling means to make the visible image density fall in the range of neutral density, and thus the lamp voltage can be precisely determined from the parallel shifted portion of the original density proper lamp voltage curve.

A further object of the present invention is to provide an exposure control device wherein proper correction of the set point of the lamp voltage, which corresponds with the original density, based on the visible image density and on the exposure lamp voltage when the visible image density is measured is conducted, even in case the detecting parts for detecting the visible image density is stained by a toner or the like used for development. The present invention features provide a device designed to correct the set point of the lamp voltage, which corresponds with the original density, based on the ratio between the ground density and the visible image density on the photoconductor, both measured through the visible image detecting means, and on the exposure lamp voltage when visible image density is measured. Accordingly, a proper correction can be made without having any influence of stains by toner or the like in the detecting parts for visible image density, as the data for visible image density excludes an error by such toner or the like.

Still further object and feature of the present invention will become more apparent from the hereinafter detailed description of the invention when taken in conjunction with the accompanying drawings.

Figure 1:
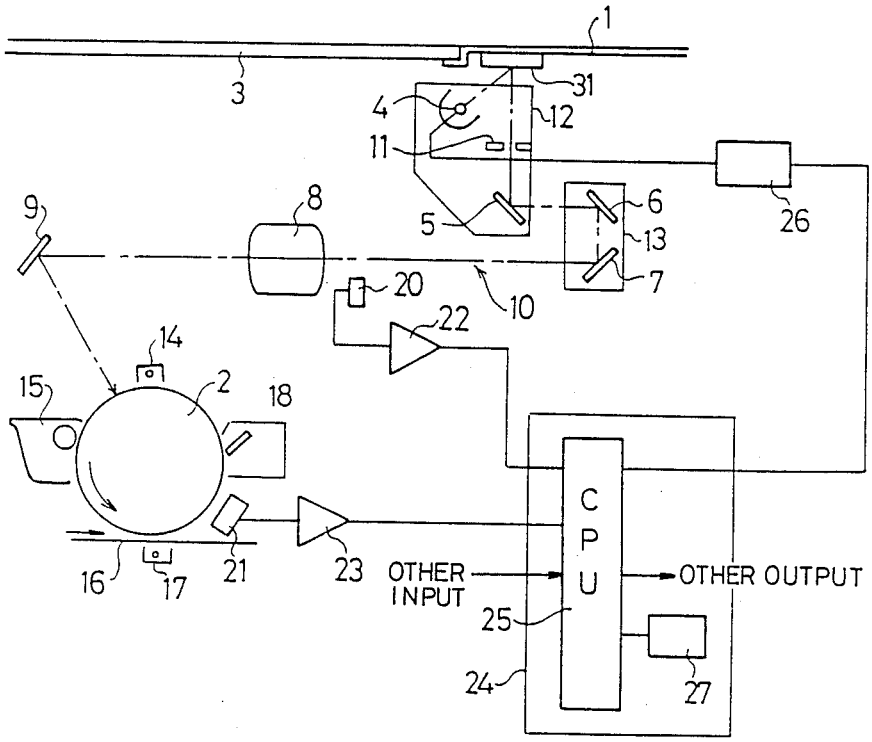
FIG. 1 is a schematic view illustrating the principal part of an electrostatic copier including an exposure control device as an embodiment of the present invention.

The first and the second embodiment of the present invention are designed to be parts of such a copying apparatus as illustrated in FIG. 1.

DETAILED DESCRIPTION OF THE INVENTION

Referring to the drawings, the embodiments of the present invention are described below.

FIG. 1 illustrates an electrostatic copier including an exposure control device as an embodiment of the present invention. In such a copier, a photoconductive drum 2 is disposed in the central portion of a housing 1, an exposure lamp 4 illuminates an original placed on a document supporting glass plate 3 on the upper surface of the housing 1, and under the glass plate 3 an exposure optical system 10, consisting of a first movable mirror 5, a second and third movable mirrors 6 and 7 provided as scanners, a projection lens 8 and a fixed mirror 9 are disposed to make a slit exposure of an original image on the photoconductive drum 2. A slit plate 11 is provided for slit exposure and is held together with the exposure lamp 4 and the first movable mirror 5 on a first movable stage 12 provided for scanning. The second 6 and the third 7 mirrors are held on a second movable stage 13, and move at half a speed of the first movable stage 12 thereby maintaining a fixed optical length. About the photoconductive drum 2, a charger 14 is disposed for uniformly charging the photoconductive drum 2 so as to form an electrostatic latent image by slit exposure, and a developing device 15 for developing the electrostatic latent image by toner, a transfer charger 17 to transfer an image developed on the photoconductive drum 2 onto a transfer sheet 16, and a cleaning device 18 to wipe off residual toner on the surface of the photoconductive drum 2 after transferring. Near the side of the projection lens 8 in the projection optical system 10, a photo sensor 20 is disposed for detecting the original density so as to receive reflection from the original, and, a photo sensor 21 for detecting the density of a visible image is disposed about the photoconductive drum 2 to receive reflection from the visible image on the photoconductive drum 2 illuminated by a light source (not shown). Each of the sensors 20 and 21 is connected through amplifiers 22 and 23 respectively, to an input port of CPU 25 in a microcomputer 24 including ROM 27 (hereinafter referred to as Micon), and an exposure value control circuit 26 which regulates the voltage of the exposure lamp 4 is connected to an output port of CPU 25. Micon 24 is for controlling the behavior of the copier and has other various information input to and output from it. The exposure can be automatically and properly set in accordance with the conditional variation of both the original and the copier by the detected signal from the sensors 20 and 21 and the memory data from the ROM 27. The more detailed description of the function of the Micon 24 is given below.

Figure 2:
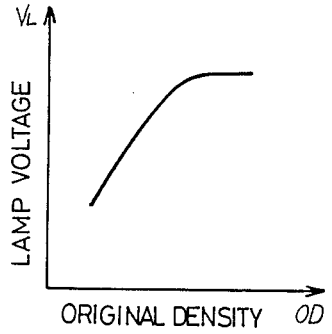
FIG. 2 is a graph showing the relation between the density of an original and the lamp voltage for automatic exposure.
Figure 3:
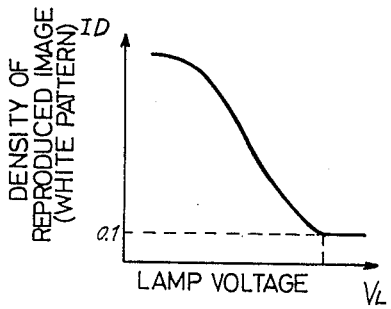
FIG. 3 is a graph showing the relation between the lamp voltage and the density of a reproduced visible image of a standard pattern.

In the conventional manner of automatic exposure, the voltage of the exposure lamp 4 is controlled according only to the original density. The relation between the original density OD and the lamp voltage $V_L$ is shown in FIG. 2. However, the density of a reproduced image varies even if the original density remains the same, when there is a conditional change of the copier related to image formation, caused by dust stains in the projection optical system 10, or the characteristic changes of the photoconductive drum 2, the charger 14 or the developing unit 15. More precisely, even if the proper exposure value is set according to the conventional method, fine lines and thin letters on the original may be blurry or may not show up through reproduction. Also the white background of the original may be stained due to fogging when reproduced. Hence, in consideration of the changes in the image forming conditions of the copier, the device is designed to detect the density of the visible image formed on the photoconductive drum 2 by the sensor 21 in order to correct the lamp voltage $V_L$ obtained according only to the original density OD. For easy detection and reliable reproduction, a white pattern 31 is set at a position opposite to the first movable mirror 5 being positioned in a scan start position to form a visible image for the purpose of detecting the visible image density. The density is obtained through exposure and development of the white pattern 31 onto the photoconductive drum 2 prior to each reproduction. In this case, where the white pattern 31 is exposed at a certain lamp voltage $V_L$ and reproduced, the relation between the lamp voltage $V_L$ and the density of reproduced image ID becomes as shown in FIG. 3. On the other hand, the relation between the output $V_S$ of the sensor 21, which detects the visible image density on the photoconductive drum 2, and the density ID of the reproduced visible image is known beforehand. The relation between the output $V_S$ and the density ID is memorized in the ROM 27, so that the density ID can be known from the output $V_S$.

Figure 4:
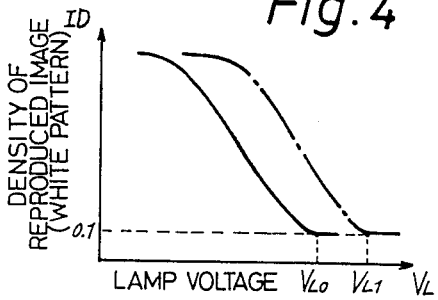
FIG. 4 is a graph showing an example of the reproduced image density - lamp voltage curve shift when the image forming characteristics of a copier are varied.

When the $V_L$-ID curve is changed from the solid line to the alternate long and short dash line as shown in FIG. 4 as the characteristics of the projection optical system 10, the photoconductive drum 2, the charger 14, the developing device 15 and etc., the lamp voltage, which corresponds to ID=0.1 (the limit density of the reproduced image to avert fogging), is changed from $V_{L0}$ to $V_{L1}$.

The lamp voltage $V_L$ in automatic mode is set to correspond with the original density in such a way that the lamp voltage would be higher when the original becomes darker in order to avoid fogging of the reproduced image as shown in FIG. 2. In the first embodiment of the present invention, the device always sets the lamp voltage at the minimum of the range, in which there is no fogging of the reproduced image regardless of original density, for the purpose of obtaining the proper contrast of the reproduced image in case the original contrast is low, i.e., better reproducibility of the fine lines. This is accomplished as described below. As it can be seen in FIG. 5, when the above limit lamp voltage, at which the reproduced image does not fog through exposure and development of the white pattern 31, is changed from $V_{L0}$ to $V_{L1}$, the OD-$V_L$ curve in automatic mode, such as shown in FIG. 2, is shifted from the solid line to the alternate long and short dash line. In other words, the lamp voltage for the white pattern 31 is shifted from $V_{L0}$ to $V_{L1}$.

Figure 5:
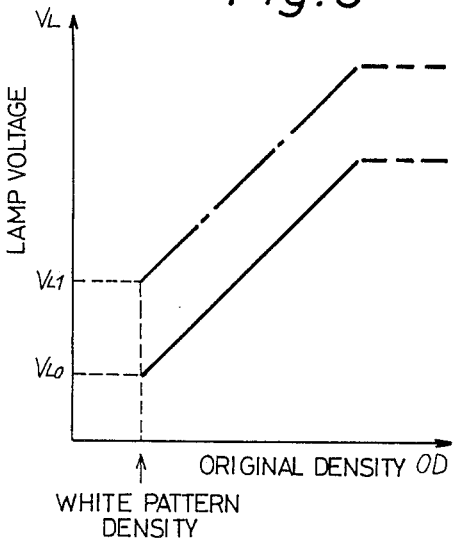
FIG. 5 is a graph showing an example of the original image density - lamp voltage curve shift according to the image forming characteristics of a copier.

Therefore, even when the image formation characteristics of the projection optical system 10, the photoconductive drum 2, the electrified charger 14 and the developing device 15 are varied, a clear image with nicely reproduced fine lines and without any fogging can always be obtained irrespective of original density. If the original density is above a certain value, the fogging problem is inevitable, even when the lamp voltage is set at its maximum. FIG. 5 shows this undesirable range by a broken line.

Figure 6:
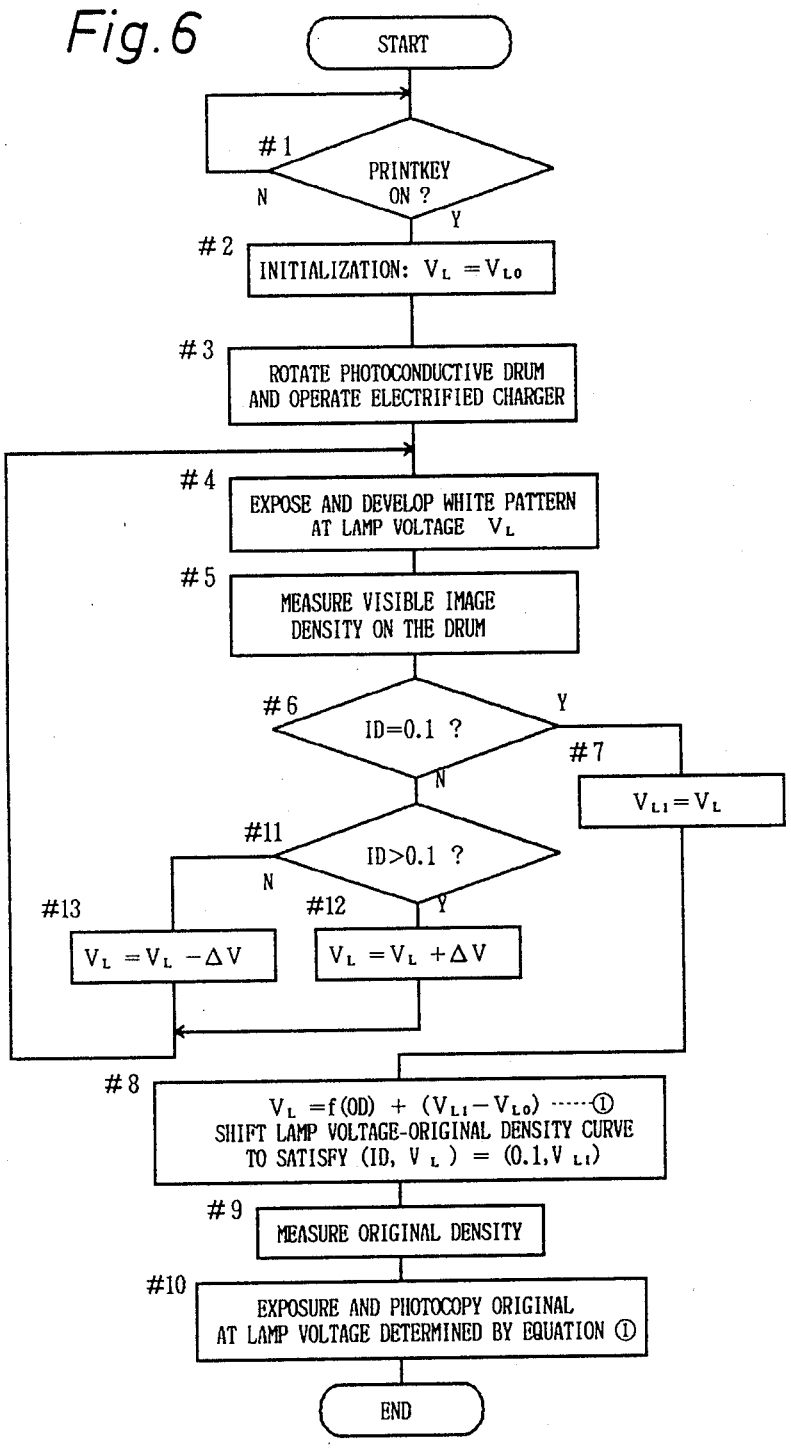
FIG. 6 is flow chart showing the automatic exposure control in a first embodiment of the present invention.

The control system of this invention is described below with reference to the flow chart shown in FIG. 6. The lamp voltage $V_L$, when the print key is depressed, is set as the initial value $V_{L0}$ (step #1). Then, a photoconductive drum starts rotating and an electrified charger 14 operates (steps #2 and #3). The white pattern 31 is exposed by the exposure lamp 4 at the voltage $V_L=V_{L0}$ and is developed (step #4).

At step #5 the visible image density on the photoconductive drum 2 is measured by the sensor 21, and at step #6 it is checked if the visible image density ID is equal to 0.1.

In case the density ID of the visible image on the photoconductive drum 2 is not equal to 0.1, step #11 checks if ID is over 0.1. At step #12, when ID>0.1 is confirmed, exposure and development of the white pattern 31 is repeated at the lamp voltage $V_L$ increased by $\Delta V$ until the visible image density (ID) becomes 0.1. In the case of ID<0.1, the lamp voltage $V_L$ is decreased by $\Delta V$ at step #13 and exposure and development of the white pattern 31 is repeated until the visible image density (ID) becomes 0.1.

After the visible image density (ID) on the photoconductive drum 2 is made equal to 0.1 at step #6, $V_{L1}$ is set to $V_L$ at step #7, and then the lamp voltage -original density curve is shifted so that the lamp voltage for the white pattern density would be equal to $V_{L1}$ (step #8). That is, $$V_L=f(OD)+(V_{L1}-V_{L0}) \quad (1)$$

where the initial lamp voltage for original density is $V_L=f$ (OD), and the initial lamp voltage for the white pattern density is equal to $V_{L0}$. The modification of the image forming characteristics of the copier is thus translated into a lamp voltage $V_L$ adjustment in relation to original density OD when in an automatic exposing mode. At the next step #9, the original density OD is measured, and then at step #10, exposure and reproduction are conducted at the lamp voltage based on the above expression (1) and on the obtained OD.

Figure 7:
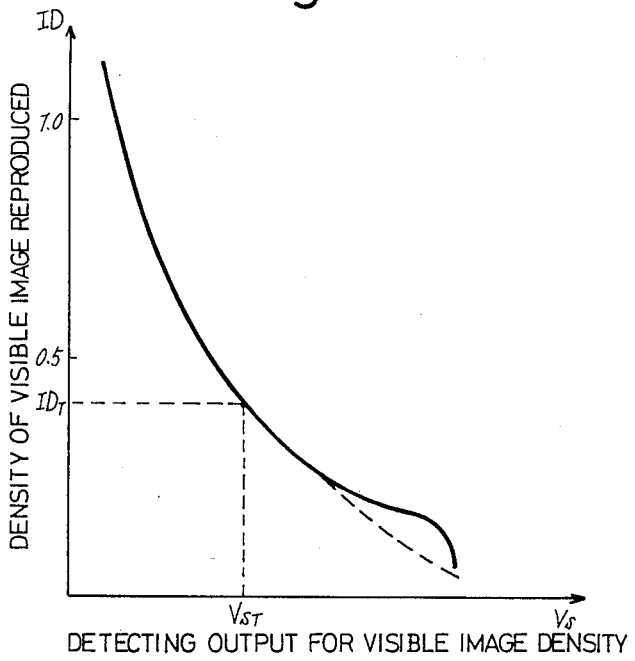
FIG. 7 is graph showing the relation between the detecting power of the visible image density when reproduced and the reproduced image density.

When output $V_S$ of the sensor 21, which detects the visible image density on the photoconductive drum 2, is in proportion to the amount of reflection light of the visible image, $V_S$ is expressed as an exponential function of ID. However, if ID is below 0.2, the surface of the photoconductive drum 2 affects $V_S$ and it is no more an exponential function of ID (broken line) and becomes insensitive to ID. On the other hand, if ID is over 0.7, $V_S$ also becomes insensitive to ID as $V_S$ does not vary as much as ID varies. Therefore, in the second embodiment of the present invention, which is described below, exposure and development is conducted at the lamp voltage which corresponds to the density of the visible image on the photoconductive drum 2 of 0.2–0.7, i.e. neutral tone density. As the relation between ID and $V_S$ shown by a solid line in FIG. 7, is memorized by ROM 27, $ID_T$ can be precisely measured from the output $V_{ST}$ detected by the sensor 21.

Figure 8:
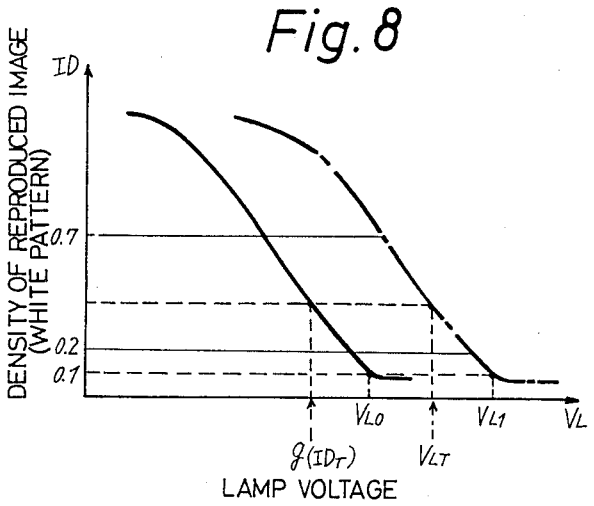
FIG. 8 is a graph showing an example of the reproduced image density - lamp voltage curve shift when the image forming characteristics of a copier are changed as in FIG. 4, but focused on the neutral density zone.

When the $V_L$ - ID curve is shifted as shown in FIG. 8 (from the solid line to the alternate long and short dash line) in response to the characteristics variation of the projection optical system 10, the photoconductive drum 2, the charger 14, and the developing device 15, the lamp voltage (threshold value), which makes the output $V_S$ of the sensor 21 correspond to ID=0.1 (the minimum density that avoids fogging), changes from $V_{L0}$ to $V_{L1}$. In the half tone zone where reproduced image density is 0.2–0.7, it is assumed that the $V_L$ - ID curve moves in parallel to the original curve. In other words, if the initial voltage $V_L$ is expressed as a function merely of ID as shown by a solid line in FIG. 8, the alternate long and short dash line which satisfies ($V_L$, ID)=($V_{L1}$, $ID_T$) expresses the lamp voltage $V_{L1}$ at ID=0.1 as $$V_{L1}=V_{LT}+\{V_{L0}-g(ID_T)\} \quad (2)$$

where the constant value $V_{L0}$ and the function g(ID) are memorized in ROM 27. The $V_{L1}$ can be more precisely obtained from the half tone density $ID_T$ and the lamp voltage $V_{LT}$ thereto, than from the lamp voltage $V_{L1}$ for the visible image density when the white pattern is exposed and developed.

The sensor 21 disposed opposite to the photoconductive drum 2 to measure the visible image density is easily stained by toner, and actual output $V_S'$ of the sensor 21 gradually decreases in power resulting in the larger instrumental error of the visible image density measurement. In order to prevent such a problem from happening, the second embodiment of the present invention measures the ground of photoconductive drum 2 when there is no visible image assuming the output of sensor 21 to be $V_{S0}$, a corrected output $V_S$ is calculated as follows:

$$V_S = V_S' \times \frac{K}{V_{S0}} \quad (3)$$

where k stands for the output of the sensor 21 when it is not stained by the toner and when the ground of photoconductive drum 2 is measured. In other words, since both $V_S'$ and $V_{S0}$ are affected by toner stains, the stains virtually do not influence $V_S$. The $V_S$ obtained from equation (3) is also irrelevant to the characteristics of sensor 21 and of amplifier 23 affected by temperature. As in the first embodiment, the second embodiment of this invention sets the lamp voltage at the minimum of the range, in which there is no fogging of the reproduced image regardless of original density, for the purpose of obtaining the proper contrast of the reproduced image in case the original contrast is too low, i.e. better reproducibility of fine lines; this is accomplished by shifting the OD - $V_L$ curve as shown in FIG. 5.

Figure 9:
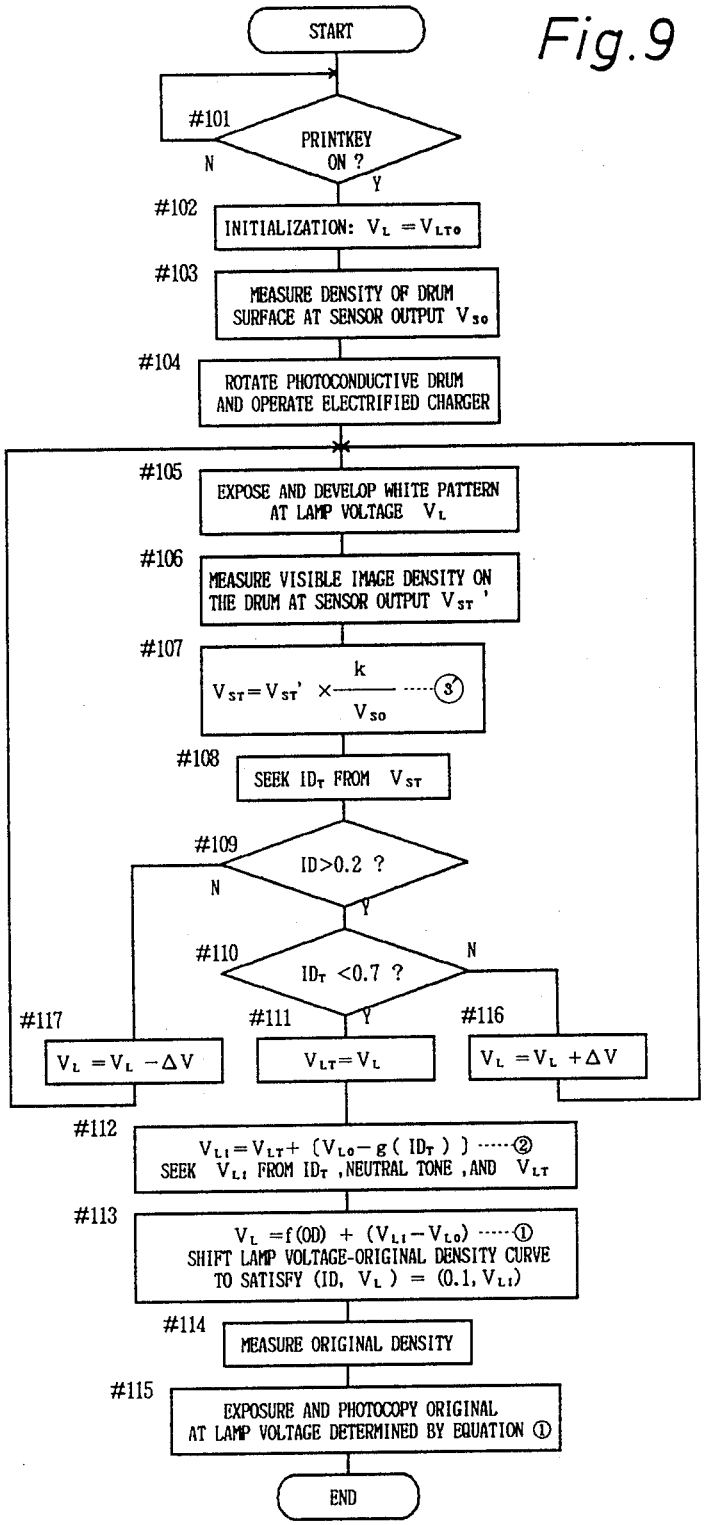
FIG. 9 is a flow chart showing the automatic exposure control in the second embodiment of the present invention.

The control system in the second embodiment of the present invention is described below in detail with reference to the flow chart shown in FIG. 9.

At step #101, the print key is depressed, and the lamp voltage $V_L$ is set as the initial value $V_{LT0}$ at step #102. Then at step #103, the surface density of the photoconductive drum 2 when there is no visible image on the drum 2 is measured as the output $V_{S0}$ of the sensor 21.

After the above steps, the photoconductive drum 2 starts rotating and the charger 14 is turned on (step #104). Then, the white pattern 31 is exposed and developed at the exposure lamp 4 voltage $V_{LT0}$. After measuring the visible image density formed on the photoconductive drum 2 as the output $V_{ST}'$ of the sensor 21 (steps #105 and #106), and the following calculation is conducted.

$$V_{ST} = V_{ST}' \times \frac{K}{V_{S0}} \quad (3')$$

As the relation between $V_S$ and ID (FIG. 7) is memorized in ROM 27, $ID_T$ can be obtained from $V_{ST}$ (step #108).

When $ID_T$ is in the half tone density zone of $0.2 < ID_T 0.7$, step #111 through steps #109 and #110 is conducted to set $V_{LT} - V_L$.

Afterward, a calculation $$V_{L1} = V_{LT} + \{V_{LT} - g(ID_T)\} \quad (2)$$

is conducted at step #112. The function g(ID) represents an initial value of function on ID in relation to $V_L$, at which the white pattern 31 is exposed and developed, as shown by a solid line in FIG. 8. The values g(ID) and $V_{L0}$, which is a pre-set lamp voltage at ID=0.1, are known and memorized in ROM 27. Therefore, the precise value of the lamp voltage $V_{L1}$ at ID=0.1 is obtained from $ID_T$ and $V_{LT}$ for the half tone density.

The next step #113 shifts the OD - $V_L$ curve to make it satisfy (OD, $V_L$)=(0.1, $V_{L1}$) as shown in FIG. 5. In other words, $V_L$ is calculated from the following equation:

$$V_L = f(OD) + (V_{L1} - V_{L0}) \quad (1)$$

wherein the initial lamp voltage determined by original density is f(OD) and the initial lamp voltage determined by white pattern 31 density is $V_{L0}$.

The modification of the image forming characteristics of the copier is thus translated into lamp voltage $V_L$ adjustment in relation to original density OD when in automatic exposing mode. At the next step #114, the original density OD is measured, and then at step #115, exposure and reproduction are conducted at the lamp voltage based on the above expression (1) and on the obtained OD. In case $ID_T$ (Density of the visible image on the photoconductive drum 2) $\leqq 0.2$, which is out of half tone density zone, step #117 is conducted after step #109, and the lamp voltage $V_L$ is decreased by $\Delta V$ to repeat exposing and developing the white pattern 31 until the visible image density falls in the range of $0.2 < ID_T < 0.7$. In case $ID_T \geqq 0.7$, which is also out of half tone density zone, step #116 is conducted after step #110, and the lamp voltage $V_L$ is increased by $\Delta V$ to similarly repeat exposing and developing the white pattern 31 until the visible image density falls in the range of $0.2 < ID_T < 0.7$. After $ID_T$ has become over 0.2 but below 0.7 (half tone density), copying is finally conducted as described (step #109–#115).

What is claimed is:

1. A control system for varying the exposure of an original in an electrostatic image forming system, comprising:
   - a light source responsive to voltage input;
   - means for positioning an original document for exposure by the light source;
   - means for applying an initial predetermined voltage to the light source;
   - means for developing an electrostatic image of the original including a photosensitive member that received the image;
   - a reference pattern that is positioned for exposure by the light source and development by the photosensitive member;
   - means for sampling the image density of the reference pattern;
   - means for sampling the image density of the image of the reference pattern developed on the photosensitive member including a sensor;
   - memory means for storing a predetermined table of values corresponding to a relationship between the density of the reproduced reference pattern and the sensor;
   - means for defining a relationship between the light source voltage and the density of the reproduced reference pattern as modified by the value in the memory means;
   - comparator means for comparing the measured image density with a predetermined image density to produce a correction signal, and
   - means for providing a fixed increment adjustment of the relationship between the light source voltage and the density of the reproduced reference pattern in response to the correction signal, whereby a light surface voltage is determined for an exposure operation from the density of the reproduced reference pattern.

2. A control system as defined in claim 1 wherein the reference pattern is white.

3. A control system as defined in claim 2 wherein the means for applying a predetermined voltage is set at the minimum voltage that prevents fogging of the white pattern image on the photosensitive member.

4. A control system as defined in claim 3 further including means for compensating for any variation in sensing the image density by the effect of any toner on the sensor.

5. A method of controlling a voltage to be supplied to a lamp which can illuminate an original in a copying machine, wherein an electrostatic latent image is formed by projecting an original image on a photosensitive member and then the electrostatic latent image is transferred onto a transfer paper after making it into a visible image by development, the copy machine is provided with an original density detecting means for detecting the original density, a standard pattern disposed at a position where it can be illuminated by the lamp which illuminates the original and a visible image density of the standard pattern, comprising the steps of:
   - (a) forming a visible image by developing a latent image obtained by exposing the standard pattern with the lamp to which an optional lamp voltage ($V_L$) is supplied;
   - (b) obtaining the visible image density (ID) by the visible image density (ID) based on a first predetermined characteristic data which shows a relationship between the lamp voltage for the standard pattern and an image density;

(d) obtaining a voltage difference ($V_L - g(ID)$) between the lamp voltage ($V_L$), when the visible image is formed, and the lamp voltage (g(ID)) obtained by the characteristic data;

(e) obtaining a lamp voltage (f(OD)) for the original density obtained by the original density detecting means based on a second predetermined characteristic data which shows a relationship between the original detected and the lamp voltage to be supplied to the lamp corresponding to its density, and (f) determining a voltage ($f(OD) + V_L - g(ID)$) as the voltage to be supplied to the lamp for illuminating the original, wherein the voltage difference ($V_L - g(ID)$) is added to the lamp voltage (f(OD)).

6. A method according to claim 5, wherein the standard pattern is a white pattern.

7. A method according to claim 5, step (b), wherein the visible image density detecting means includes a sensor which outputs a voltage corresponding to the density detected, and a visible image density is calculated based on a third predetermined characteristic data which shows the relationship between the density detected and the output voltage corresponding to the density.

8. A method according to claim 7, further including correcting the output of the visible image density detecting means with a means for correcting the third predetermined characteristic data by detecting the surface of the photosensitive member when no visible image exists.

* * * * *